US010934703B2

(12) United States Patent
Wilkinson et al.

(10) Patent No.: US 10,934,703 B2
(45) Date of Patent: Mar. 2, 2021

(54) ACOUSTIC DAMPENING FIRE STOP

(71) Applicants: William Thomas Wilkinson, Toronto (CA); Donald Vincent Wilkinson, Mississauga (CA)

(72) Inventors: William Thomas Wilkinson, Toronto (CA); Donald Vincent Wilkinson, Mississauga (CA)

( * ) Notice: Subject to any disclaimer, the term of this patent is extended or adjusted under 35 U.S.C. 154(b) by 0 days.

(21) Appl. No.: 16/599,232

(22) Filed: Oct. 11, 2019

(65) Prior Publication Data

US 2020/0115895 A1 Apr. 16, 2020

Related U.S. Application Data

(60) Provisional application No. 62/746,228, filed on Oct. 16, 2018.

(51) Int. Cl.
*E04B 1/82* (2006.01)
*E04B 1/94* (2006.01)

(52) U.S. Cl.
CPC ..... *E04B 1/8209* (2013.01); *E04B 1/947* (2013.01); *E04B 1/948* (2013.01); *E04B 2001/8263* (2013.01)

(58) Field of Classification Search
CPC ..... E04B 1/947; E04B 2001/8263; E04B 1/8209; E04B 2001/8254; A62C 2/065
See application file for complete search history.

(56) References Cited

U.S. PATENT DOCUMENTS 3,949,529 A * 4/1976 Porter ..... E04B 1/7612 52/281
5,048,257 A 9/1991 Luedtke
5,765,332 A * 6/1998 Landin ..... E04B 1/948 52/235
5,868,399 A * 2/1999 Schluter ..... B32B 5/26 277/650
5,913,788 A 6/1999 Herren
5,974,750 A * 11/1999 Landin ..... E04B 1/948 52/396.01
6,948,287 B2 * 9/2005 Korn ..... E04B 1/68 277/510
7,240,905 B1 7/2007 Stahl, Sr.
7,665,272 B2 * 2/2010 Reen ..... E04G 23/0203 52/742.14
7,797,893 B2 * 9/2010 Stahl, Sr. ..... F16L 5/04 52/220.8
7,941,981 B2 5/2011 Shaw
(Continued)

FOREIGN PATENT DOCUMENTS

CN 203626082 U 6/2014
CN 204059670 U 12/2014
(Continued)

*Primary Examiner* — Adriana Figueroa
(74) *Attorney, Agent, or Firm* — Anglehart et al.

(57) ABSTRACT

A sound control firestop device. It has a horizontal pad portion made from an elastomeric or fibrous material with a first surface and a second surface opposite the first surface, the horizontal pad portion having a length and a width; and a vertical projection spacer portion projecting outwardly from the second surface, wherein the vertical projection portion extends across at least a portion of the width of the horizontal pad portion. A method of installation thereof.

8 Claims, 7 Drawing Sheets

(56) References Cited

U.S. PATENT DOCUMENTS

| | | | | |
|---|---|---|---|---|
| 8,074,412 | B1 | 12/2011 | Gogan et al. | |
| 8,286,397 | B2 * | 10/2012 | Shaw | E04B 1/948 52/232 |
| 8,353,139 | B2 * | 1/2013 | Pilz | E04B 1/948 52/232 |
| 8,601,760 | B2 * | 12/2013 | Hilburn, Jr. | E04B 1/947 52/232 |
| 8,935,897 | B2 * | 1/2015 | Shaw | E04B 1/948 52/125.2 |
| 9,290,932 | B2 | 3/2016 | Pilz et al. | |
| 9,371,644 | B2 * | 6/2016 | Pilz | E04B 1/947 |
| 9,523,197 | B2 * | 12/2016 | Sessler | E04B 2/7457 |
| 10,597,867 | B2 * | 3/2020 | Hulteen | B32B 27/12 |
| 2005/0102941 | A1 | 5/2005 | Barr | |
| 2013/0118102 | A1 * | 5/2013 | Pilz | E04B 1/948 52/232 |
| 2014/0075865 | A1 | 3/2014 | Pilz et al. | |
| 2015/0135631 | A1 | 5/2015 | Foerg et al. | |
| 2015/0275506 | A1 | 10/2015 | Klein et al. | |
| 2016/0376787 | A1 * | 12/2016 | Grisolia | E04B 1/26 52/236.3 |
| 2017/0165509 | A1 | 6/2017 | Foerg et al. | |
| 2017/0342708 | A1 | 11/2017 | Hensley et al. | |
| 2018/0112395 | A1 * | 4/2018 | Hulteen | E04B 1/948 |
| 2019/0127974 | A1 * | 5/2019 | Dicaire | E04B 1/948 |

FOREIGN PATENT DOCUMENTS

| | | | | |
|---|---|---|---|---|
| DE | 3602118 | A1 * | 7/1987 | E04B 1/947 |
| EP | 0335347 | A1 * | 10/1989 | E04B 1/948 |
| EP | 1008698 | A2 | 6/2000 | |
| GB | 2472402 | A * | 2/2011 | E04B 1/948 |
| GB | 2501492 | A | 10/2013 | |
| JP | 2015025350 | A | 2/2015 | |

* cited by examiner

ACOUSTIC DAMPENING FIRE STOP

The present application claims priority from U.S. provisional patent application No. 62/746,228 filed on Oct. 16, 2018, incorporated herein by reference.

TECHNICAL FIELD

The present disclosure relates to the field of sound control, and more particularly to sound control and firestops in buildings.

BACKGROUND

Multi-storey buildings, such as condominium constructions, townhouses and apartments, may be built using a wood and/or metal frame structure. These buildings are often over three storeys tall. Due to population densification in urban areas, the construction of these buildings is increasing in order to accommodate the growing number of urban residents.

Each of the units of a building may be separated by an air gap area that may be filled with a firestop (e.g. mineral wool). A firestop provides fire protection by sealing openings and joints in a wall or floor assembly.

These tall buildings may suffer from certain construction issues. First, the material of these buildings is lightweight and may therefore be more prone to sound transfer. Second, due to the height of the building, the structure may lack rigidity along the different axes and may sway due to the flexibility of the wood and metal studs. A solution is to insert a floor plate that extends between units. However, the use of the inter-unit floor plate may result in the creation of an acoustic flanking path, where sound from one unit travels to the other. As such, the inter-unit floor plate solution creates the problem of poor sound control, despite providing additional rigidity to the structure.

Therefore, finding a solution that provides the tall building structure with additional rigidity while controlling the passage of sound and vibration between units would be advantageous.

SUMMARY

The present disclosure relates to a sound control firestop device positioned over floor assemblies of a frame structure of a building that increases the strength of the frame structure such that wall assemblies and/or the subfloor assemblies, of the building do not move apart nor move together. The sound control firestop device is also made of a material that reduces the travel of sound and vibration between the different units by being made of a material with a vibrational frequency that is different from that of the building's frame structure (usually made of metal and/or wood, with e.g. concrete). Moreover, the sound control firestop device acts as a firestop by hindering the travel of fire and/or smoke through the firestop gap.

The sound control firestop device is added to the frame structure during the construction of the building. The sound control firestop device is incorporated to the frame structure of the building.

The sound control firestop device may have a first pad portion that may be flat and horizontal, adapted to be placed over the floor assembly, and, in some cases, under the wall assemblies (e.g. the sill plates of the wall assemblies). The sound control firestop device may also have a second vertical spacer portion extending outwardly from the first horizontal portion. The second vertical spacer portion may be adapted to fit in the space between the floor joints of the building structure. The first pad portion may prevent movement of the wall assemblies such that they do not move apart. The second portion may prevent the wall assemblies from moving together.

Another broad aspect is a kit for providing firestopping properties and sound control to a building, installed during the construction of the building. The kit includes a horizontal pad portion made from an elastomeric or fibrous material with a first surface and a second surface opposite the first surface, the horizontal pad portion having a length and a width. The second surface of the horizontal pad portion is adapted to be placed over at least two subfloor assemblies separated by a firestop gap. The first surface of the horizontal pad portion is adapted to receive two wall assemblies separated by the firestop gap. The kit includes a vertical projection spacer to be positioned in the firestop gap.

In some embodiments, the spacer may be provided separately from the horizontal pad portion.

In some embodiments, the spacer may be joined or joinable to the horizontal pad portion.

A first broad aspect is a method of installing a sound control firestop device during construction of a building to improve stability of the building and to reduce sound travel between units of the building, the building comprising a frame structure, the frame structure comprising at least a first floor assembly and a second floor assembly at a same level and separated by a firestop gap, and opposed wall assemblies that are separated by the firestop gap. The method includes positioning a lower surface of a horizontal pad portion of the sound control firestop device on the first floor assembly and on the second floor assembly. The method includes mounting a first one of the opposed wall assemblies and a second one of the opposed wall assemblies onto an upper surface of the horizontal pad portion, wherein the horizontal pad portion is made from a material with a vibrational frequency that is other than a vibrational frequency of wood and other than a vibrational frequency of metal, and wherein the horizontal pad portion has stretch resistance to prevent at least one of the floor assemblies; and the opposed wall assemblies from moving apart.

In some embodiments, the method may include providing a compression resistant spacer in the firestop gap.

In some embodiments, there may be at least one gap between the spacer and the floor assemblies.

In some embodiments, at least mineral wool at least partially may fill the firestop gap.

In some embodiments, the provided spacer may be elastomeric.

In some embodiments, the method may include fastening the first one of the opposed wall assemblies to the first floor assembly and to the horizontal pad portion; and fastening the second one of the opposed wall assemblies to the second floor assembly and to the horizontal pad portion.

In some embodiments, the spacer may be a projection of the sound control firestop device positioned on one of the lower surface and the upper surface of the horizontal pad portion.

In some embodiments, the spacer may be a projection of the sound control firestop device positioned on the lower surface of the horizontal pad portion.

In some embodiments, the horizontal pad portion may be made of an elastomeric or fibrous material.

Another broad aspect is a sound control firestop device including a horizontal pad portion made from an elastomeric or fibrous material with a first surface and a second surface opposite the first surface, the horizontal pad portion having a length and a width; and a vertical projection spacer portion projecting outwardly from the second surface, wherein the vertical projection spacer portion extends across at least a portion of the width of the horizontal pad portion.

In some embodiments, the vertical projection spacer portion may be made from a cellular foam, an elastomeric or fibrous material.

In some embodiments, the horizontal pad portion may be made from a rubber elastomer.

In some embodiments, the rubber elastomer may be reinforced with a mesh.

In some embodiments, the vertical projection spacer portion may be positioned at or near a middle of the length of the horizontal pad portion.

In some embodiments, the vertical projection spacer portion may include an intumescent material.

In some embodiments, the intumescent material may be provided as a strip.

In some embodiments, the vertical projection portion may be fastened to the horizontal pad portion.

Another broad aspect is a frame structure of a building including at least a first floor assembly and a second (i.e. adjacent) floor assembly at a same level and separated by a firestop gap, and opposed wall assemblies separated by the firestop gap; and a sound control firestop device comprising a horizontal pad portion made of a first material with an upper surface and a lower surface, wherein the first material has a vibrational frequency that is other than a vibration frequency of wood and other than a vibrational frequency of metal, wherein the lower surface of the horizontal pad portion is positioned on the first floor assembly and the second floor assembly, and wherein the opposed wall assemblies are mounted onto the upper surface of the horizontal pad portion.

In some embodiments, the frame structure may include a compression resistant spacer positioned in the firestop gap for preventing the opposed wall assemblies from moving together.

In some embodiments, the compression resistant spacer may be part of the sound control firestop device and projects from one of the lower surface and the upper surface of the horizontal pad portion.

In some embodiments, the compression resistant spacer may project from the lower surface of the horizontal pad portion.

In some embodiments, at least mineral wool may at least partially fill the firestop gap.

Another broad aspect is a kit for controlling sound and for acting as a firestop. The kit includes a horizontal pad portion made from an elastomeric or fibrous material with a first surface and a second surface opposite the first surface for positioning over two adjacent floor assemblies that are separated by a firestop gap, wherein two wall assemblies are to be received on one of the first surface and second surface of the pad portion; and a compression resistant spacer for positioning in the firestop gap for preventing the opposed wall assemblies from moving together.

In some embodiments, the kit may include a fastener for fastening the spacer to the pad portion.

BRIEF DESCRIPTION OF THE DRAWINGS

The invention will be better understood by way of the following detailed description of embodiments of the invention with reference to the appended drawings, in which.

DETAILED DESCRIPTION

Figure 1:
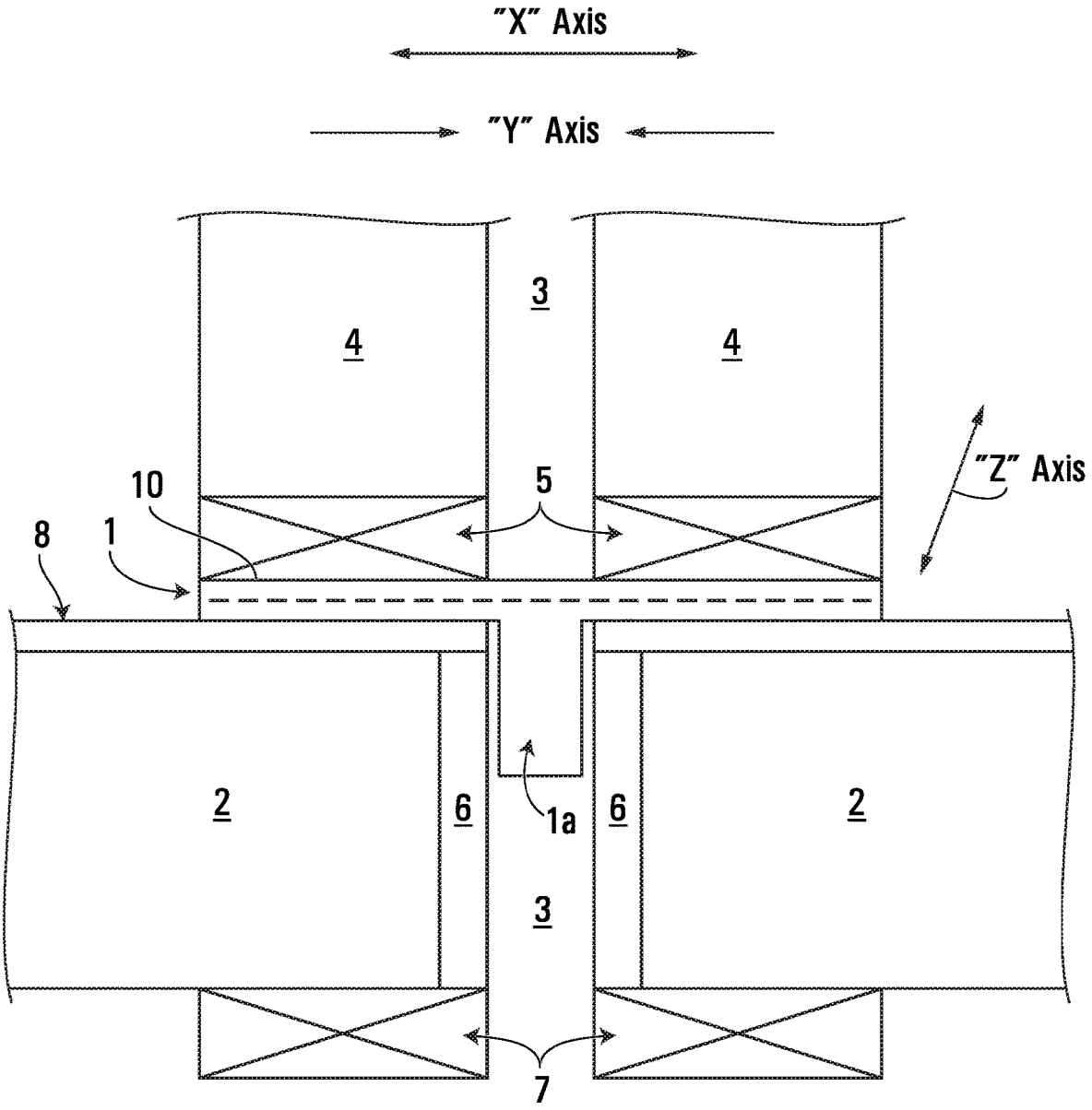
FIG. 1 is a drawing of a cross-sectional side view of an exemplary sound control firestop device installed over exemplary floor assemblies, wherein exemplary opposed wall assemblies are mounted onto the sound control firestop device.

The present disclosure relates to a sound control firestop device installed during the construction of a building to increase the solidity of the frame structure of the building while reducing sound travel (e.g. noise) between units (e.g. rooms; suites; studios; etc.) of the building.

The sound control firestop device has a flat pad portion that is placed horizontally over floor assemblies of the frame structure, the floor assemblies separated by a firestop gap. The opposed wall assemblies, also separated by the firestop gap, are mounted onto an upper surface of the pad portion of the sound control firestop device. As such, the pad portion provides resistance to the opposed wall assemblies, preventing the opposed wall assemblies from moving apart.

Moreover, a compression resistant spacer may be provided (as part of the horizontal pad portion or as a separate component) that is positioned in the firestop gap, preventing the opposed wall assemblies from moving together.

The sound control firestop device is made of a material that has a vibrational frequency that is other than the vibrational frequency of the material of the frame structure (usually metal, concrete or wood). As such, due to the difference in vibrational frequency between the frame structure and the sound control firestop device, where the pad portion is placed over the floor assembly, sound travelling to the next adjacent unit from one unit, resulting from vibration, is at least reduced. For instance, there may be an impedance mismatch when sound vibration reaches the interface between the frame structure and the pad portion of the sound control firestop device (due to the difference in the vibrational frequency of the materials).

Sound Control Firestop Device:

Reference is made to FIGS. 2A-2D, illustrating an exemplary sound control firestop device 10.

The sound control firestop device 10 includes a horizontal flat pad portion 1. The sound control firestop device 10 may also have a spacer portion 1*a*.

The pad portion 1 may be shaped as a parallelogram (e.g. a rectangle, a square) and has sufficient surface area to be placed over at least two floor assemblies located at a same height in the frame structure.

The pad portion has a width 11 and a length 12. In some examples, the length of the pad portion may be three feet or one meter. It will be understood that the length of the pad portion 1 may vary depending on the dimensions of the firestop gap between the floor assemblies, the distance between the wall assemblies, and/or the dimensions of the floor assemblies.

The pad portion 1 has a thickness (e.g. ⅛ to ¾ of an inch). The thickness of the pad portion may vary without departing from the present teachings. It will be understood that the height of the wall assemblies mounted onto the pad portion 1 may have to be adjusted to compensate for the added height provided by the pad portion 1 (e.g. the height of the wall assemblies reduced to compensate for the increase provided by the thickness of the pad portion.)

The pad portion 1 provides a first surface (e.g. 16) and a second surface (e.g. 17) opposite to the first surface. The first surface may receive the wall assemblies and provides resistance to the wall assemblies such that the wall assemblies mounted thereon do not move apart.

The pad portion 1 may also be made of a material that has a vibrational frequency other than the vibrational frequency of the material used for the frame structure (e.g. metal, wood and/or concrete). Exemplary materials of the pad portion include a fibrous material such as jute or felt, or elastomeric material such as elastomeric rubber. In some examples, the elastomeric material may be reinforced, such as with a reinforcing mesh. In some examples, the pad portion 1 may be made from a foam.

The sound control firestop device 10 may also have a spacer portion 1*a*. The spacer portion 1*a* may be a projection of the first surface and/or the second surface of the sound control firestop device 10.

Figure 2A:
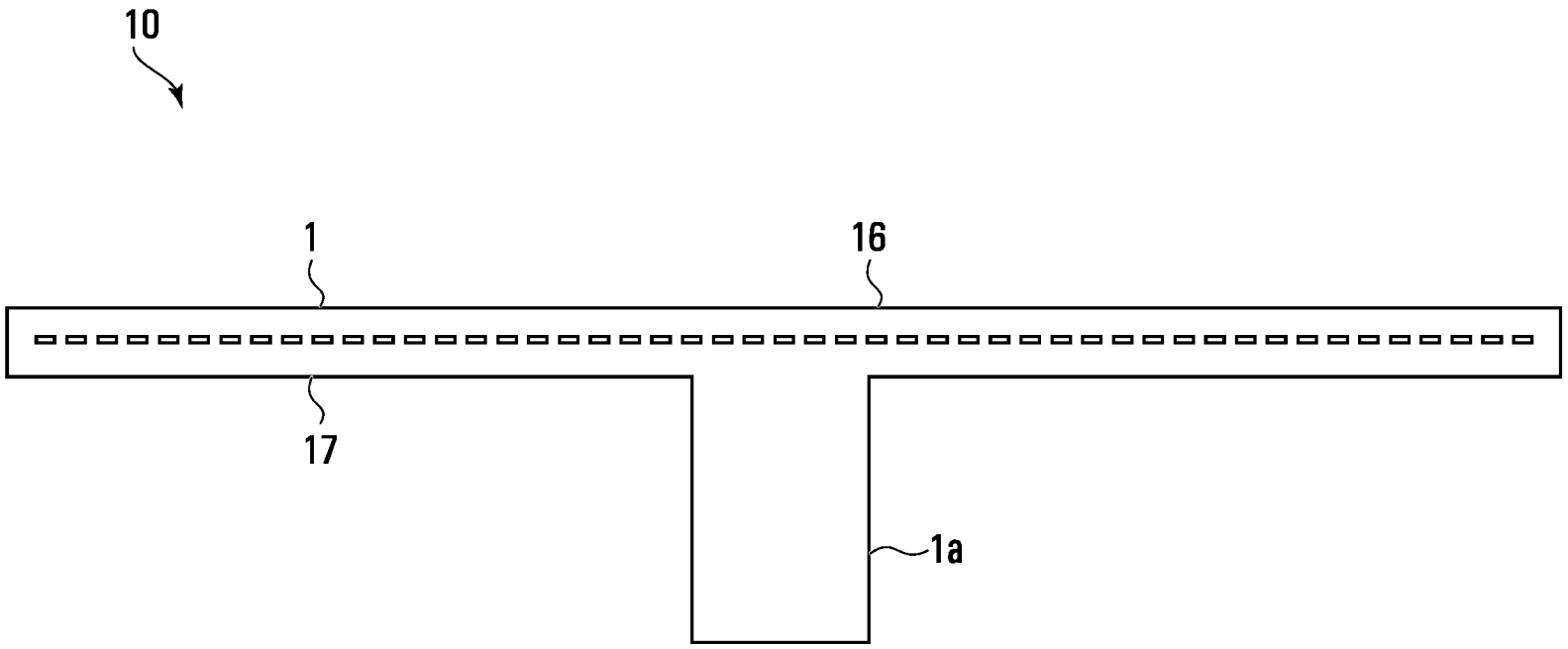
FIG. 2A is a drawing of a cross-sectional sideview of an exemplary sound control firestop device.
Figure 2B:
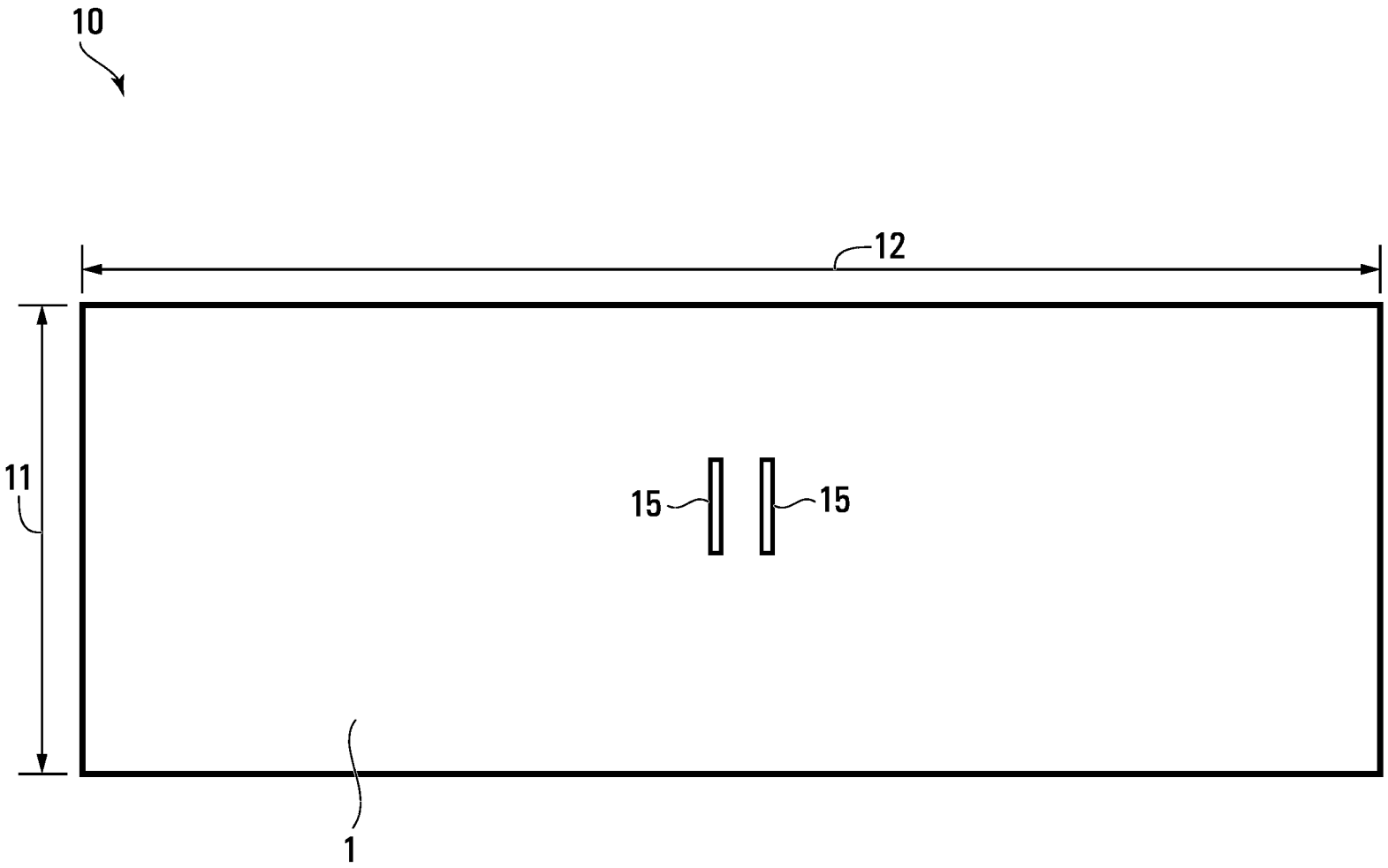
FIG. 2B is a drawing of a top view of an exemplary sound control firestop device.

The spacer portion 1*a* may span at least a portion of the width 11 of the horizontal pad portion 1. As shown in FIG. 2B, the spacer portion 1*a* may span the entire width 11 of the horizontal pad portion 1.

The spacer portion 1*a* is adapted to fit into a firestop gap and prevent opposed wall assemblies from closing the firestop gap and moving together. As such, the spacer portion 1*a* may be made of a compression resistant material. For instance, the spacer portion may be made of a foam (e.g. cellular foam), elastomeric rubber or fibrous material.

In some examples, the spacer portion 1*a* includes an intumescent material (e.g. composed with ammonium polyphosphate, pentaerythritol and melamine, etc.) As such, when a fire breaks out in a building, the spacer portion 1*a*, composed of an intumescent material, expands to take up more space in the firestop gap. In some examples, the spacer portion 1*a* may be provided with an intumescent strip 13 running, e.g. along at least a portion of the length of the spacer portion 1*a*.

In some examples, the spacer portion 1*a* may have a thickness of e.g. 0.8 inches. It will be understood that the thickness of the spacer portion 1*a* may vary as a function, e.g., of the width of the firestop gap and the portion of the width of the firestop gap that the spacer is meant to fill (e.g. in some cases, providing a space between the spacer and the wall).

In some examples, the pad portion 1 and the spacer portion 1*a* may be a single part, where the spacer portion 1*a* is integral (e.g. molded or extruded) to the pad portion 1. In other examples, the spacer portion 1*a* may be joined, e.g. during installation or during manufacturing, to the pad portion 1. The spacer portion 1*a* may be joined to the pad portion 1 using a fastening such as glue, one or more staples, one or more nails, one or more bolts, by melting the material of the spacer portion 1*a* and/or pad portion 1 such that the spacer portion 1*a* and the pad portion 1 may bind together, etc. In some examples, the spacer portion 1*a* may be defined as multiple spacers interspersed intermittently along the width of the pad portion 1.

Figure 2C:
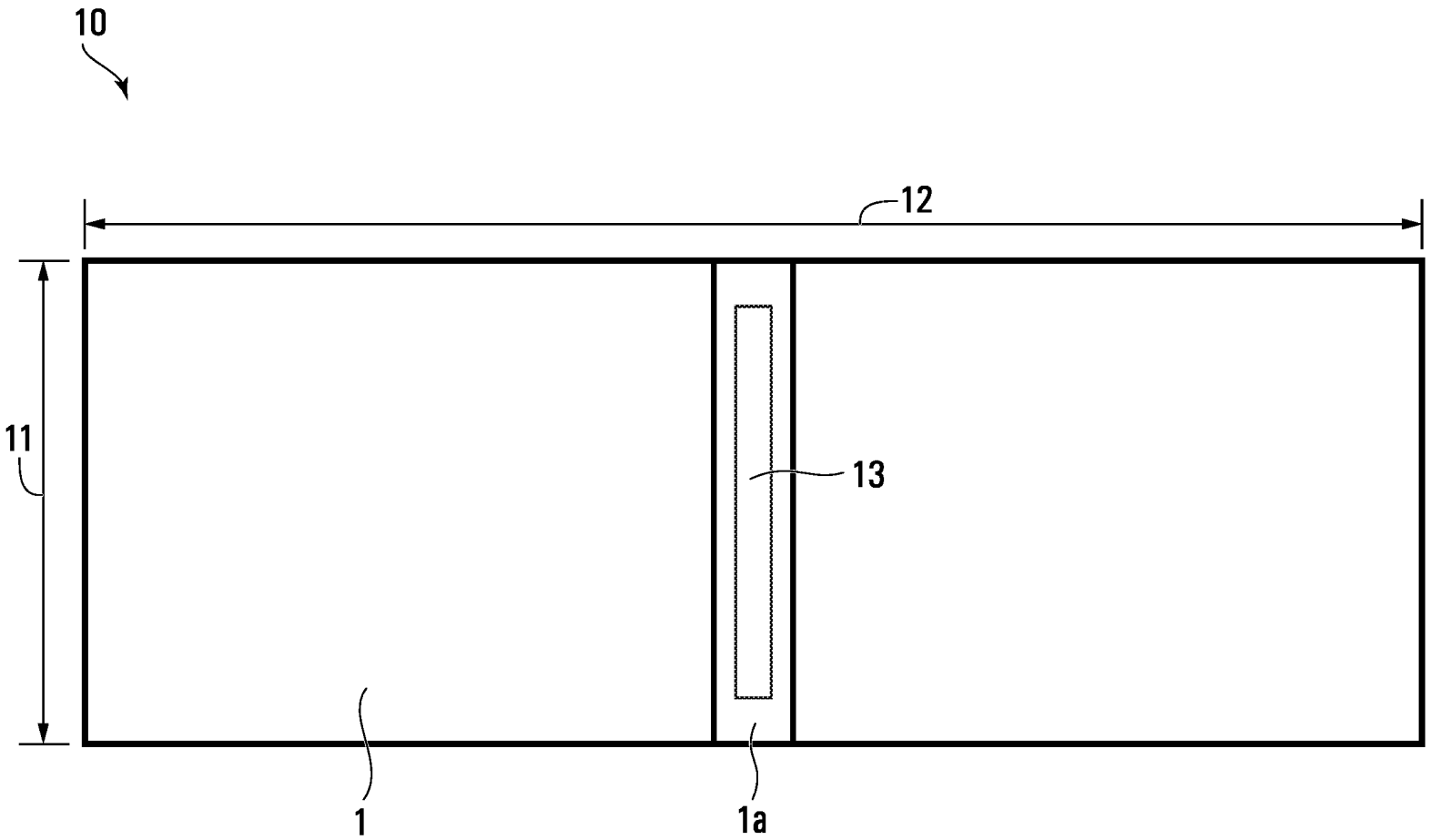
FIG. 2C is a drawing of a bottom view of an exemplary sound control firestop device.

In some examples, as shown in FIG. 2C, the spacer portion 1*a* may be positioned at a middle of the length 12 of the pad portion 1. It will however be understood that the spacer portion 1*a* may be positioned anywhere along the length of the pad portion 1, or run the continuous length, or even oriented in the direction of the width of the pad portion 1, without departing from the present teachings.

Figure 2D:
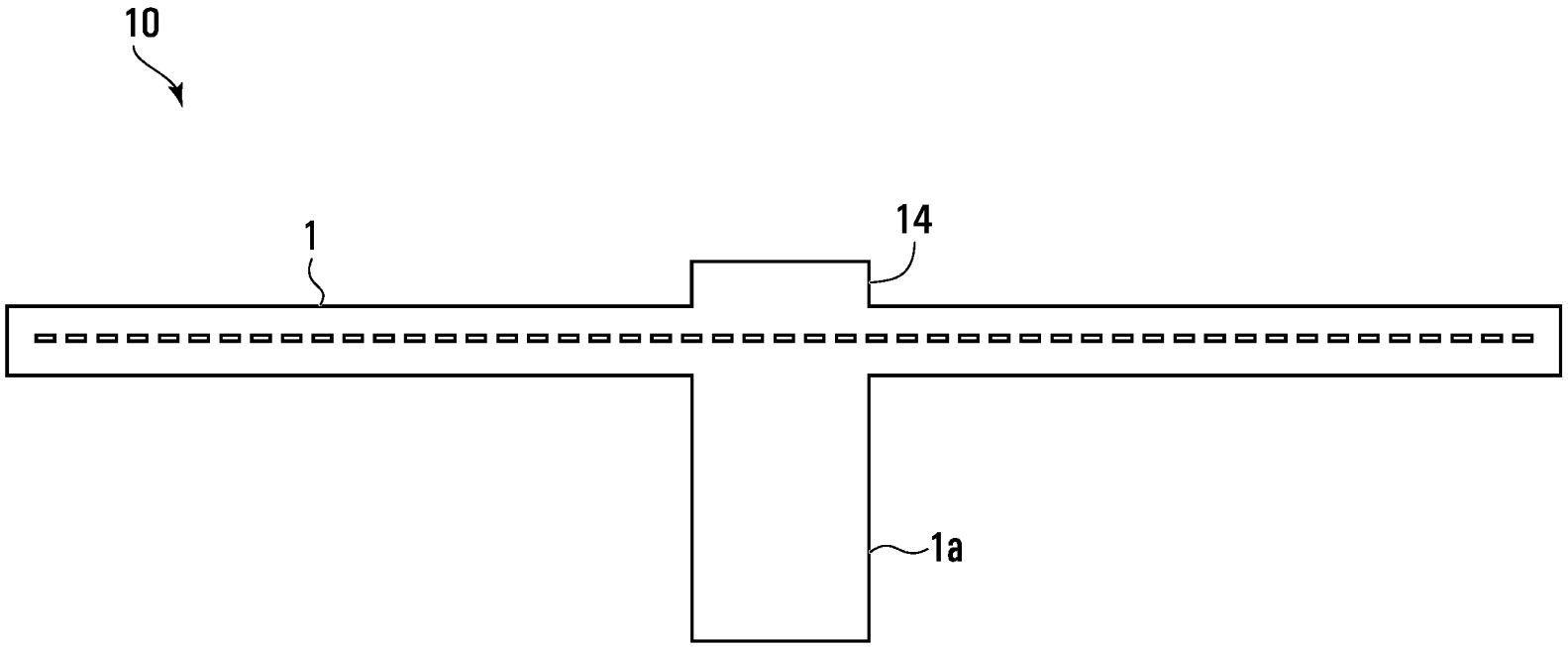
FIG. 2D is a drawing of a cross-sectional view of an exemplary sound control firestop device with an exemplary upper abutment.

In some examples, as shown in FIG. 2D, the sound control firestop device 1 may also have an abutment 14 on the first surface to be placed in the portion of the firestop gap opposite the portion of the firestop gap into which the spacer portion 1*a* may be placed. The abutment 14 may therefore provide further stability to the frame structure, where opposed wall assemblies are further prevented to move together by the abutment 14. Abutment 14 may also be made of a compression resistant material (e.g. an elastomer such as, e.g., rubber). The abutment 14 may be positioned above the spacer portion 1*a*. In some examples, the abutment 14 may be of the same thickness as that of the spacer portion 1*a*. In other examples, the abutment 14 may be of a different thickness than that of the spacer portion 1*a*. The length of the abutment 14 may be less, equal or greater than the length of the spacer portion 1*a*.

The pad portion 1, and in some examples, the spacer portion 1*a*, is made of a material with a vibrational frequency that is other than the vibrational frequency of the material of the frame structure (e.g. wood, concrete and/or metal). The vibrational frequency is the natural frequency at which the material vibrates when disturbed. The vibrational frequency may vary, e.g., depending on the rigidity of the object. A difference in vibrational frequency of the material of the pad portion 1 and the material of the frame structure may cause an impedance mismatch and a mechanical energy loss, resulting in sound reduction between adjacent units of the building. The pad portion 1 and the spacer portion 1*a* may be made out of a material that resists or prevents the propagation of vibration. Such materials include, but are not limited to, fibrous materials (e.g. jute) or elastomeric materials (e.g. elastomeric rubber, with or without a reinforced mesh; thermoplastic elastomers, thermoplastic vulcanizates, thermoplastic olefins, reclaimed styrene-butadiene rubber, tire crumb, etc.)

In some embodiments, the pad portion 1 may include on the first surface or on the second surface one or more indicators or markings 15 to provide guidance for the placement of the wall assembly onto the pad portion 1.

The Sound Control Firestop Device with Respect to the Frame Structure of a Building:

Reference is now made to FIG. 1, illustrating an exemplary sound control firestop device 10 installed in a portion of a frame structure of a building.

Figure 3:
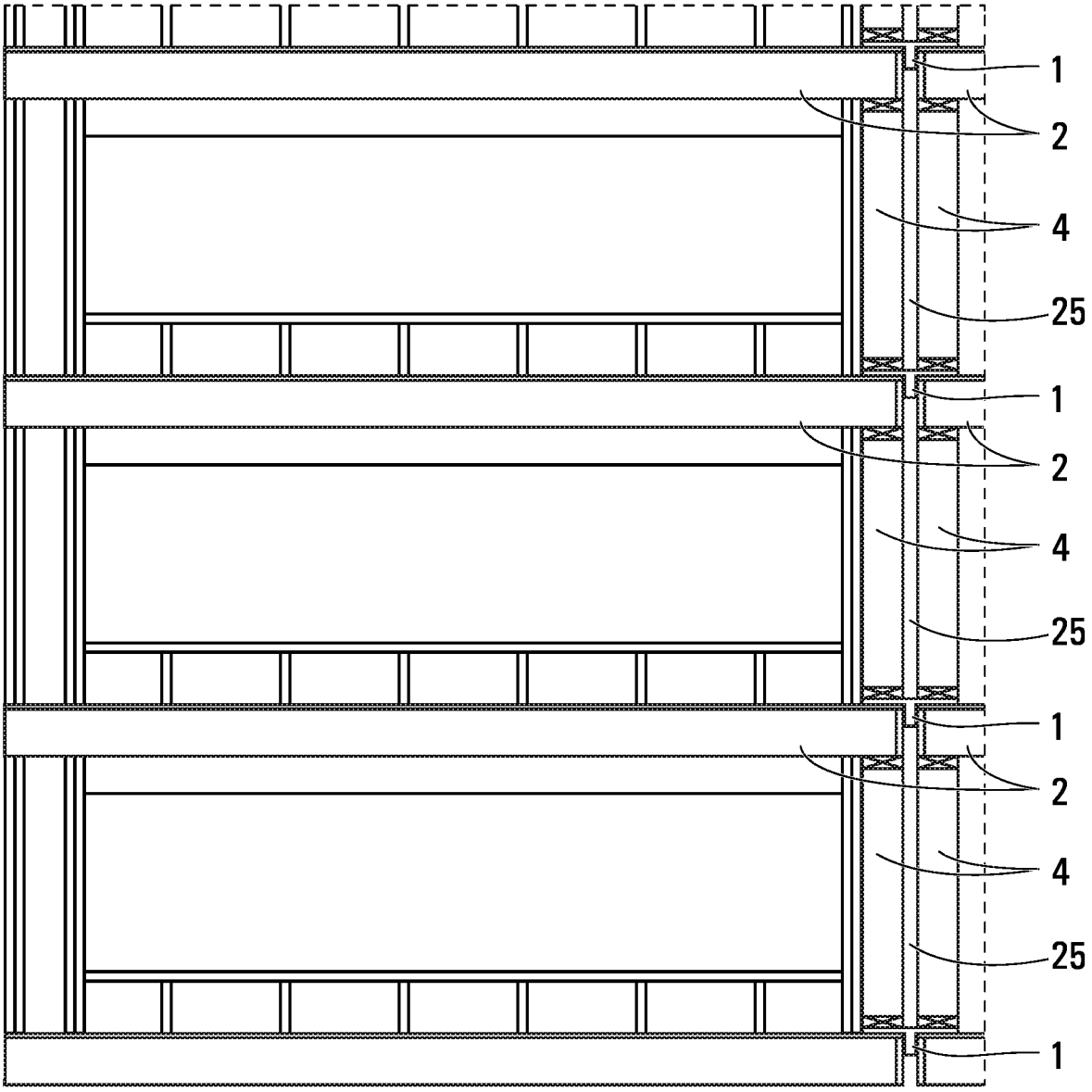
FIG. 3 is a drawing of an exemplary frame structure for an exemplary building.

The frame structure provides structure, support and shape to the building. The frame structure of a building includes floor assemblies, wall assemblies, and may include a roof assembly. FIG. 3 illustrates exemplary frame structures.

A floor assembly is a portion of a frame structure that acts as at least part of a floor of a building. The floor assembly may include a subfloor plate, floor joists, rim joists, etc. (as these terms are known in the art). It will be understood that a floor assembly may include other components that act as a foundation for a floor of the building. For instance, with reference to FIG. 1, the floor assembly may include the subfloor plate 8, the floor joist 2 and the rim joist 6.

A wall assembly of a building is a portion of the frame structure used to build walls of the building. The wall assembly may include a wall stud and, in some examples, a sill plate, a wall header plate, etc. (as these terms are known in the art). It will be understood that a wall assembly may include other components as are known in the art without departing from the present teachings. With reference to the example of FIG. 1, a wall assembly may include the sill plate 5, a wall stud 4 and a wall header plate 7.

As shown in FIG. 1, the wall assemblies may be opposed and separated by a firestop gap 3. As is known in the art, a wall assembly would usually rest on a floor assembly. However, as explained herein, the wall assembly is instead mounted onto the pad portion 1 of the sound control firestop device 10.

With reference to FIG. 1, the lower surface of the pad portion 1 of the sound control firestop device 10 is positioned on floor assemblies that are at a same level and separated by a firestop gap 3. As shown in the example of FIG. 1, the pad portion 1 may rest directly on the subfloor plate 8 of the floor assembly. However, it will be understood that the lower surface of the pad portion 1 may rest onto any horizontal flat component of the floor assembly.

In the example of FIG. 1, the pad portion 1 is shown to extend over portions of two floor assemblies. However, it will be understood that in some examples, the pad portion 1 may be positioned to span, e.g., four floor assemblies on the same level, the floor assemblies positioned such that each would occupy a quadrant. In other examples, the pad portion may span more than two floor assemblies positioned on the same level in the same row. In other examples, multiple pad portions 1 may be placed to cover multiple sets of two floor assemblies.

The upper surface of the pad portion 1 is adapted to receive the opposed wall assemblies that are positioned over the floor assemblies receiving the pad portion 1. The upper surface of the pad portion 1 provides stretch resistance in a horizontal direction to prevent the opposed wall assemblies and/or the floor assemblies from moving apart. In some examples, the pad portion 1 may be made of a material for causing high friction to provide resistance. In some examples, the pad portion 1 may be fastened to the floor assembly using, e.g., glue, one or more nails, one or more screws, one or more bolts, one or more staples, or nailed directly through the wall assembly (e.g. sill plate), through the pad portion 1 and into the floor assembly, etc.

In some examples, the wall assembly made be fastened to the pad portion 1 and to the floor assembly using, e.g., a screw, a nail, a bolt, etc. As such, this fastening may provide further stability to the wall assembly mounted onto the pad portion 1, such that the opposed wall assemblies are further prevented from moving away from or towards one another.

A spacer (e.g. spacer portion 1*a*; or a spacer separate from the pad portion 1) is positioned in the firestop gap 3 to prevent the opposed wall assemblies from moving together. In some examples, the spacer, once placed in the firestop gap, provides at least one gap between the spacer and the portion of the frame structure that defines the firestop gap. As such, the gap between the frame structure and the spacer reduces sound (including vibration) travel between units. In some examples, the spacer may be dimensioned and positioned in the firestop gap 3 to provide a small gap on either side of the spacer.

In some examples, the spacer may be dimensioned to abut both floor assemblies when the spacer is made from a material that mitigates the passage of vibration, e.g., made from felt material.

In some examples, the firestop gap may be filled with a fire-retardant material 25 such as mineral wool, fiberglass, etc.

The spacer may be made of a compression resistant material such that the spacer does not deform significantly under the strain of the wall assemblies (and, e.g., the walls). As such, the spacer prevents the opposed wall assemblies from moving together.

In other examples, when the spacer contains an intumescent material or is provided with an intumescent strip, the spacer may expand in the presence of fire, occupying a larger portion of the firestop gap 3 when a fire starts in a building, acting to prevent the progression of the fire.

Figure 4:
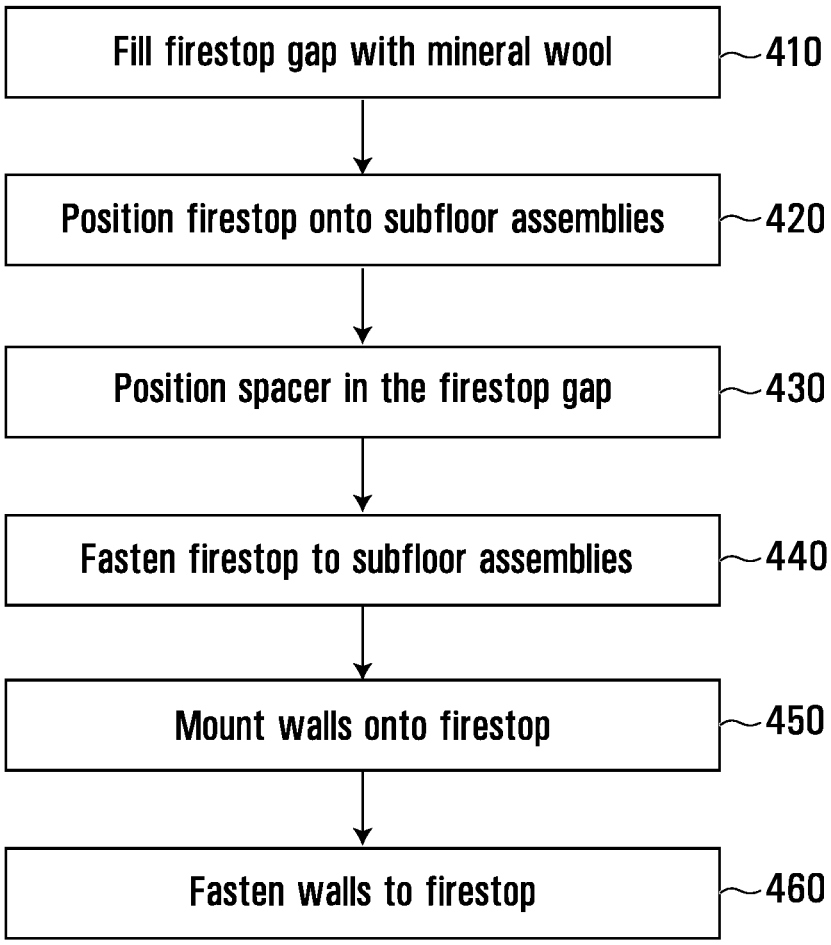
FIG. 4 is a flowchart diagram of an exemplary method of installing a sound control firestop device during construction of a building.

An Exemplary Method of Installing a Sound Control Firestop Device During Construction of a Building:

Reference is now made to FIG. 4, illustrating an exemplary method 400 of installing a sound control firestop device, such as sound control firestop device 10, during the construction of a building. The sound control firestop device reduces sound travel between units while contributing to the stability of the frame structure of the building.

It will be understood that, in some examples, the sequence of steps of method 400 may vary without departing from the present teachings.

For purposes of illustration, reference is made to exemplary sound control firestop device 10. However, it will be understood that any other sound control firestop device may be installed, as described herein, when performing exemplary method 400.

In some examples, the firestop gap 3 may be filled with a fire-retardant material such as mineral wool, fiberglass, foam, etc. at step 410. The fire-retardant material placed in the unoccupied space of the firestop gap is used for slowing the progress of fire in the building.

Floor assemblies of a building are assembled such that there is a firestop gap (a space) between two adjacent floor assemblies on a same level. Once the floor assemblies of the frame structure are installed for at least a portion of a given floor of a building, the lower surface of the pad portion 1 of the sound control firestop device 10 is positioned on at least two floor assemblies on a same level at step 420. The two floor assemblies are separated by a firestop gap. The lower surface of the pad portion 1 may rest, for instance, on the subfloor plates of the floor assemblies. The floor assemblies receiving the pad portion 1 may be adjacent.

In some examples, the pad portion 1 may be placed over four adjacent floor assemblies having a quadrant configuration.

In some examples, a spacer may be positioned in the firestop gap separating, e.g., the floor assemblies (and separating, or that will be separating, the wall assemblies) at step 430. For instance, when the spacer is part of the sound control firestop device 10 and connected to the pad portion 1, the positioning of the pad portion 1 on the floor assemblies is done such that the spacer 1*a* fits into the firestop gap separating the floor assemblies. In the examples where mineral wool is added into the firestop gap 3, when the spacer 1*a* is supplied separately from the pad portion 1, the spacer 1*a* may be added to the firestop gap 3 at the same time as the mineral wool.

In some embodiments, when the thickness of the spacer is less than the size of the firestop gap, there may be one or more gaps created when the spacer is placed in the firestop gap, the gap(s) created between the frame structure and the sides of the spacer at step 430. This or theses gaps may help reduce sound travel between units.

In some embodiments, the pad portion 1 of the sound control firestop device 10 may be fastened to the floor assembly at step 440. For instance, the pad portion 10 may be fastened to the floor assembly (or floor assemblies) receiving the pad portion 1 using glue, one or more staples, one or more nails, one or more bolts, by melting the material of the spacer portion 1*a* and/or pad portion 1 such that the spacer portion 1*a* and the pad portion 1 may bind together, etc.

Opposed wall assemblies are mounted onto the upper surface of the pad portion 1 of the sound control firestop device at step 450. The wall assemblies are mounted in such a way that they define the firestop gap between the opposed wall assemblies. As such, the opposed wall assemblies are located above the corresponding floor assemblies, the pad portion positioned between wall assembly and the opposite floor assembly.

The pad portion 1 provides stretch resistance in a horizontal or diagonal direction, thereby preventing the floor assemblies and/or the wall assemblies from moving apart, increasing the stability of the frame structure.

The upper and/or lower surfaces of the pad portion 1 may be made of a material that increases static friction between the pad portion with the floor assemblies and/or the wall assemblies.

In some examples, a wall assembly may also be fastened through the pad portion 1 of the sound control firestop device 10 and the floor assembly that is located below the wall assembly at step 460. The wall assembly may be fastened to the pad portion 1 and to the floor assembly using, e.g., one or more screws, one or more bolts, one or more rods, one or more nails, etc. As such, this fastening may provide further stability to the wall assembly mounted onto the pad portion 1, such that the opposed wall assemblies are further prevented from moving away from or towards one another.

With the sound control firestop device installed, the spacer, which may be made of a compression resistant material, prevents the wall assemblies and floor assemblies from moving together, as the floor assemblies may abut on the sides of the spacer (or the fire-retardant material placed next to, or attached to the spacer). Moreover, the pad portion 1, captured between the floor assemblies and the wall assemblies, made of a material with a vibrational frequency other than the vibrational frequency of the material(s) of the frame structure, impedes or prevents sound and vibration from travelling across floor assemblies to adjacent units of the building, while preventing the mounted wall assemblies, and/or the floor assemblies, from moving apart, providing additional stability to the frame structure of the building.

Additionally, the sound control firestop device acts as a firestop by blocking the vertical path created in the firestop gap of the building, hindering the progress of fire throughout the building.

Method of Manufacturing the Sound Control Firestop Device:

An exemplary method of manufacturing a sound control firestop device is described herein.

In one example, the pad portion of the firestop may be made out of an elastomer rubber (e.g. reclaimed rubber) by, e.g., cutting out portions of a long strip of the elastomer. The pad portion may be cut to meet different length (and width) requirements specific to the dimensions of the building.

In some examples, the spacer portion may then be fastened onto a surface of the pad portion as explained herein.

In other examples, the sound control firestop device, or the pad portion and/or the spacer portion, may be manufactured via extrusion injection, or compression molding (e.g. where the mold may contain or include the mesh in order to reinforce the elastomer forming the sound control firestop device).

Although the invention has been described with reference to preferred embodiments, it is to be understood that modifications may be resorted to as will be apparent to those skilled in the art. Such modifications and variations are to be considered within the purview and scope of the present invention.

Representative, non-limiting examples of the present invention were described above in detail with reference to the attached drawing. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings.

Moreover, combinations of features and steps disclosed in the above detailed description, as well as in the experimental examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

What is claimed is:

1. A method of installing a sound control device during construction of a building to improve stability of said building and to reduce sound travel between units of said building, said building comprising a frame structure, said frame structure comprising at least a first floor assembly and an adjacent second floor assembly at a same level and separated by a firestop gap, and opposed wall assemblies that are separated by said firestop gap, comprising:

positioning a lower surface of a horizontal pad portion of said sound control device on said first floor assembly and on said second floor assembly;

mounting a first one of said opposed wall assemblies and a second one of said opposed wall assemblies onto an upper surface of said horizontal pad portion, wherein said horizontal pad portion is made from a material with a vibrational frequency that is other than a vibrational frequency of wood and other than a vibrational frequency of metal, wherein said horizontal pad portion has stretch resistance to prevent at least one of: said floor assemblies; and said opposed wall assemblies from moving relative to one another; and providing a compression resistant spacer in said firestop gap;

wherein said spacer is a projection of said sound control firestop device positioned on one of said lower surface and said upper surface of said horizontal pad portion.

2. The method as defined in claim 1, wherein there is at least one gap between said spacer and said floor assemblies.

3. The method as defined in claim 2, wherein mineral wool at least partially fills said firestop gap.

4. The method as defined in claim 1, wherein said provided spacer is elastomeric.

5. The method as defined in claim 1, further comprising:

fastening said first one of said opposed wall assemblies to said first floor assembly and to said horizontal pad portion; and fastening said second one of said opposed wall assemblies to said second floor assembly and to said horizontal pad portion.

6. The method as defined in claim 1, wherein said spacer is a projection of said sound control firestop device positioned on said lower surface of said horizontal pad portion.

7. The method as defined in claim 1, wherein said horizontal pad portion is made of an elastomeric or fibrous material.

8. A method of installing a sound control device during construction of a building to improve stability of said building and to reduce sound travel between units of said building, said building comprising a frame structure, said frame structure comprising at least a first floor assembly and a second adjacent floor assembly at a same level and separated by a firestop gap, and opposed wall assemblies that are separated by said firestop gap, comprising:

positioning a spacer portion made from a foam-based, elastomeric or fibrous material in said firestop gap;

positioning a lower surface of a horizontal pad portion of said sound control device on said first floor assembly and on said second floor assembly, said lower surface of said horizontal pad portion joined to the spacer portion such that said spacer portion extends orthogonally from said horizontal pad portion; and mounting a first one of said opposed wall assemblies and a second one of said opposed wall assemblies onto an upper surface of said horizontal pad portion, wherein said horizontal pad portion is made from a fibrous or elastomeric material with a vibrational frequency that is other than a vibrational frequency of wood and other than a vibrational frequency of metal, and wherein said horizontal pad portion has stretch resistance to prevent at least one of:

said floor assemblies; and said opposed wall assemblies from moving relative to one another.

* * * * *